US010745784B2

(12) United States Patent
Tobita et al.

(10) Patent No.: US 10,745,784 B2
(45) **Date of Patent: *Aug. 18, 2020**

(54) HIGH RIGID SPHEROIDAL GRAPHITE CAST IRON

(71) Applicant: KABUSHIKI KAISHA RIKEN, Tokyo (JP)

(72) Inventors: Tomoyuki Tobita, Niigata (JP); Tadaaki Kanbayashi, Niigata (JP)

(73) Assignee: KABUSHIKI KAISHA RIKEN, Tokyo (JP)

( * ) Notice: Subject to any disclaimer, the term of this patent is extended or adjusted under 35 U.S.C. 154(b) by 96 days.

This patent is subject to a terminal disclaimer.

(21) Appl. No.: 15/562,937

(22) PCT Filed: Sep. 15, 2015

(86) PCT No.: PCT/JP2015/077143

§ 371 (c)(1),
(2) Date: Sep. 29, 2017

(87) PCT Pub. No.: WO2016/157574

PCT Pub. Date: Oct. 6, 2016

(65) Prior Publication Data

US 2018/0112294 A1 Apr. 26, 2018

(30) Foreign Application Priority Data

Mar. 30, 2015 (JP) ..... 2015-068954

(51) Int. Cl.
*C22C 37/10* (2006.01)
*C22C 37/04* (2006.01)

(52) U.S. Cl.
CPC ..... *C22C 37/10* (2013.01); *C22C 37/04* (2013.01); *C21D 2211/006* (2013.01)

(58) Field of Classification Search
CPC .... C21D 2211/006; C22C 37/04; C22C 37/10
(Continued)

(56) References Cited

U.S. PATENT DOCUMENTS 8,771,589 B2 * 7/2014 Menk ..... C22C 37/04 148/321
9,822,433 B2 * 11/2017 Mito ..... C22C 37/04
(Continued)

FOREIGN PATENT DOCUMENTS

CN 102392178 A * 3/2012
JP 10-96041 4/1998
(Continued)

OTHER PUBLICATIONS

NPL: On-line translation of JP 2001220640A, Aug. 2001 (Year: 2001).*

(Continued)

*Primary Examiner* — Jie Yang
(74) *Attorney, Agent, or Firm* — Hunton Andrews Kurth LLP

(57) ABSTRACT

A high rigid spheroidal graphite cast iron, comprising: more than 3.0% to less than 3.6% of C, 1.5 to 3.0% of Si, 1.0% or less of Mn, 1.0% or less of Cu, less than 0.03% of P, 0.02% to 0.07% of Mg, residual Fe and inevitable impurities, as represented by mass %, wherein a carbon equivalent (a CE value) calculated by the mathematical expression (1): CE=C %+Si %/3 in terms of C and Si contents is 3.6 to 4.3%, the Young's modulus is 170 GPa or more, the tensile strength is 550 MPa or more, and the impact value is 12 J/cm$^2$ or more.

1 Claim, 1 Drawing Sheet

(58) Field of Classification Search
USPC ..... 420/26
See application file for complete search history.

(56) References Cited

U.S. PATENT DOCUMENTS

| | | | | |
|---|---|---|---|---|
| 9,834,831 | B2 * | 12/2017 | Tobita | C22C 37/04 |
| 10,087,509 | B2 * | 10/2018 | Wang | C22C 33/08 |

FOREIGN PATENT DOCUMENTS

| | | | | |
|---|---|---|---|---|
| JP | 10-317093 | | 12/1998 | |
| JP | 2000-17372 | | 1/2000 | |
| JP | 2001-220640 | | 8/2001 | |
| JP | 2001220640 | A * | 8/2001 | |
| JP | 2002-285220 | | 10/2002 | |
| JP | 2008-156688 | A | 7/2008 | |
| JP | 2008-303434 | A | 12/2008 | |
| WO | WO-2013100148 | A1 * | 7/2013 | C22C 33/08 |
| WO | 2013/125464 | A1 | 8/2013 | |
| WO | 2014/208240 | | 12/2014 | |

OTHER PUBLICATIONS

NPL on-line translation of CN 102392178 A Mar. 2012 (Year: 2012).*
International Search Report dated Dec. 22, 2015 in PCT/JP2015/077143.

* cited by examiner

[Fig.1]
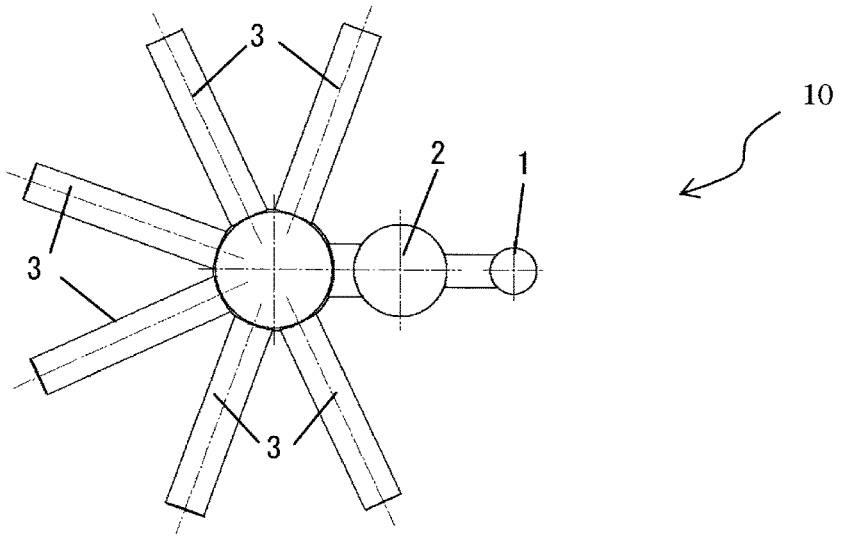
[Fig.2]
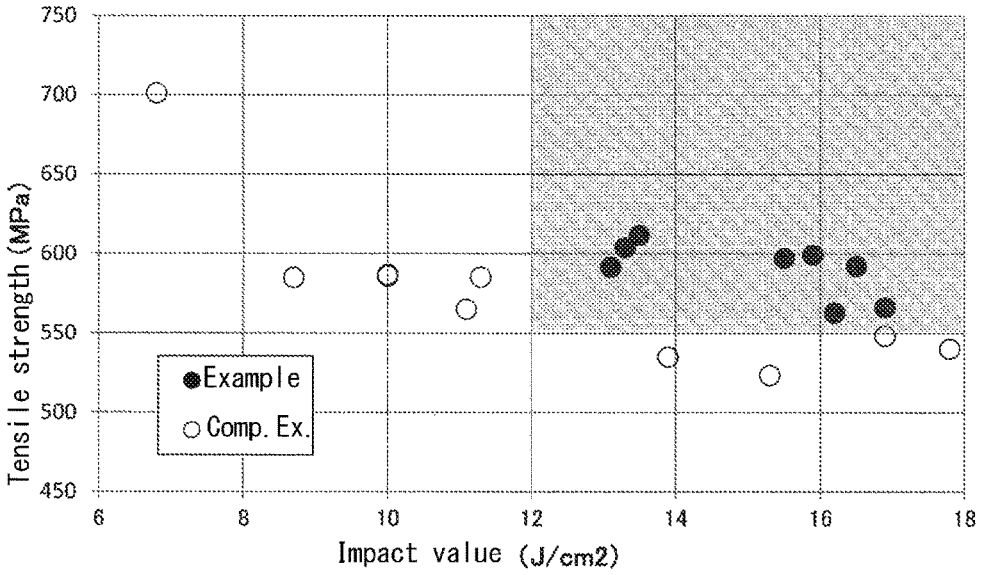

HIGH RIGID SPHEROIDAL GRAPHITE CAST IRON

CROSS-REFERENCE TO RELATED APPLICATIONS

This application is the U.S. National Phase of International Patent Application No. PCT/JP2015/077143, filed Sep. 25, 2015, which claims benefit to Japanese Patent Application No. JP 2015-068954, filed Mar. 30, 2015, the contents of each are hereby incorporated by reference in their entireties.

FIELD OF THE INVENTION

The present invention relates to spheroidal graphite cast iron, and, more particularly, to high rigid spheroidal graphite cast iron suitably applied to vehicle parts such as an undercarriage including a knuckle, a suspension arm and a brake caliper, and engine parts including a crank shaft, a cam shaft and a piston ring.

DESCRIPTION OF THE RELATED ART

In order to improve fuel efficiency and to respond environmental issues, lightweight vehicle parts are demanded. A high rigid material used for the parts is also needed. A variety of materials are used for the vehicle parts. Cast iron can be provided at low costs and can be shaped freely. Among others, spheroidal graphite cast iron has strength higher than flake graphite cast iron, and is frequently used for the vehicle parts. However, the spheroidal graphite cast iron generally used for the vehicle parts has an eutectic composition and the Young's modulus of about 165 GPa. Even if the spheroidal graphite cast iron is worked to have high strength, the Young's modulus is not changed. If the parts are thinned for light weight, rigidity cannot be held, thereby decreasing oscillation and noise characteristics. Therefore, for the vehicle parts focusing on high rigidity, cast steel having the Young's modulus higher than the cast iron is used. However, the cast steel has a casting temperature higher than the cast iron and has not good molten properties, which is difficult to be applied to a product having a complex shape or a thin shape. Also, the cast steel may easily generate shrinkage cavities as compared to the cast iron. In order to prevent the shrinkage cavities, a casting system plan needs a great feeding head, which may increase the production costs. For the lightweight vehicle parts, high rigid spheroidal graphite cast iron is needed.

In order to provide the high rigid spheroidal graphite cast iron, it is needed to increase the Young's modulus. The Young's modulus is influenced by the shape and the crystallization amount of graphite in metal structure. When the graphite has a spheroidal shape and the crystallization amount is low, the Young's modulus becomes higher. When the spheroidal graphite cast iron is sufficiently spheroidized, a main factor affecting on the Young's modulus is the crystallization amount of graphite. Therefore, by decreasing a C content, a Si content and a carbon equivalent (a CE value) in a molten metal composition affecting on the crystallization amount of graphite, the crystallization amount of graphite is suppressed and the Young's modulus is increased for high rigidity.

As such a technology, Patent Literature 1 discloses hypoeutectic spheroidal graphite cast iron including 1.5 to 3.0% of C, which is a low carbon content, and 1.0 to 5.5% of Si, as represented by mass %, in order to increase the Young's modulus and rigidity (Patent Literature 1).

In addition, Patent Literature 2 by the present applicant discloses high rigid spheroidal graphite cast iron having the Young's modulus of 170 GPa or more by defining a C content and a CE value to decrease concatenated structures of graphite (Patent Literature 2).

On the other hand, as the spheroidal graphite cast iron in the related art, FCD 450 (in accordance with JIS G 5502) having the Young's modulus of about 165 GPa and a tensile strength of 450 MPa or more is heavily used. Correspondingly, Patent Literature 3 discloses that spheroidal graphite cast iron such as FCD 500 and FCD 600 (in accordance with JIS G 5502) having strength higher than FCD 450 is used to decrease weights of parts.

Furthermore, Non-Patent Literature 1 discloses the effect of spheroidal graphite cast iron on toughness of C, Si, Mn, and P.

PRIOR ART LITERATURE

Patent Literature

[Patent Literature 1] Japanese Unexamined Patent Publication (Kokai) 2001-3134

[Patent Literature 2] Japanese Unexamined Patent Publication (Kokai) 2000-173969

[Patent Literature 3] Japanese Unexamined Patent Publication (Kokai) 2002-194479

Non-Patent Literature

[Non-Patent Literature 1] Nishiyama, et al., "impact value of spheroidal graphite cast iron", Hitachi Review, Special issue on metals, Secondary series, Supplementary volume No. 16, issued on October, 1956, pp. 85-95

Problems to be Solved by the Invention

Incidentally, as described above, even though only high strength of the spheroidal graphite cast iron is achieved, the thickness cannot be decreased in the region where the rigidity cannot be maintained regardless of sufficient strength. Thus, in order to provide lightweight vehicle parts, it is necessary to improve both of the rigidity and the strength. When a variety of components and the like of the spheroidal graphite cast iron are optimized in order to improve the rigidity and the strength, it is found that the impact value is significantly decreased in a case where 0.03% or more of P is contained. In particular, it tends to increase the effect of embrittlement by containing P at the region where additive amounts of Mn and Cu are small.

The present invention solves the above-mentioned problem, and has an object to provide high rigid spheroidal graphite cast iron having excellent strength and toughness, and the high rigidity being achieved by increasing the Young's modulus.

SUMMARY OF THE INVENTION

In order to solve the above-mentioned problems, through intense studies by the present inventors, it has been found that high rigid spheroidal graphite cast iron can be achieved by decreasing a carbon equivalent (a CE value) and increasing the Young's modulus, and that strength and toughness can be improved by setting P to less than 0.03%. Note that in a case where the total contents of Mn and Cu are controlled, more excellent properties can be provided.

The present invention provides a high rigid spheroidal graphite cast iron, comprising: more than 3.0% to less than 3.6% of C, 1.5 to 3.0% of Si, 1.0% or less of Mn, 1.0% or less of Cu, less than 0.03% of P, 0.02% to 0.07% of Mg, residual Fe and inevitable impurities, as represented by mass %, wherein a carbon equivalent (a CE value) calculated by the mathematical expression (1): CE=C %+Si %/3 in terms of C and Si contents is 3.6 to 4.3%, the Young's modulus is 170 GPa or more, the tensile strength is 550 MPa or more, and the impact value is 12 J/cm$^2$ or more.

Thus, Young's modulus is increased to 170 GPa or more by controlling the content of C and the range of CE value. Also, high rigid spheroidal graphite cast iron having improved strength and toughness can be obtained by controlling the content of P to less than 0.03%.

Preferably, the total contents of Mn and Cu are 0.45 to 0.70%, as represented by mass %.

Preferably, a ratio (P/(Mn+Cu)) of the P content and the total contents of Mn and Cu is 0.050 or less, as represented by mass %.

Effects of the Invention

According to the present invention, there is provided spheroidal graphite cast iron having high rigidity and also having excellent strength and toughness by increasing the Young's modulus.

BRIEF DESCRIPTION OF THE DRAWINGS

FIG. 1 A top view showing a beta set mold having cavities for producing Examples.

FIG. 2 A graph showing a relationship between tensile strength and impact value in each of Examples and Comparative Examples.

DESCRIPTION OF THE EMBODIMENTS

Hereinafter, embodiments according to the present invention will be described. In the context of the present invention, "%" denotes "mass %" unless otherwise specified.

The high rigid spheroidal graphite cast iron according to the embodiment of the present invention includes more than 3.0% to less than 3.6% of C, 1.5 to 3.0% of Si, 1.0% or less of Mn, 1.0% or less of Cu, less than 0.03% of P, 0.02 to 0.07% of Mg, and residual Fe and inevitable impurities as represented by mass %, where a carbon equivalent (a CE value) calculated by the mathematical expression (1): CE=C (%)+Si (%)/3 in terms of C and Si contents is 3.6 to 4.3%, the Young's modulus is 170 GPa or more, a tensile strength is 550 MPa or more, and an impact value is 12 J/cm$^2$ or more.

<Composition>

C (carbon) is an element for forming a graphite structure. In order to increase rigidity and the Yong's modulus of the spheroidal graphite cast iron, a crystallization amount of graphite has to be suppressed by decreasing the C content lower than the eutectic composition. However, if the C content is less than 2.0%, a start temperature of solidification becomes high, graphite is difficult to be crystallized and castability becomes worse, which may result in molten metal flow defects on parts having a complex shape or a thin shape, and shrinkage cavities on thick parts, for example. On the other hand, when the C content is 3.6% or more, the crystallization amount of graphite is increased, and the Young's modulus is decreased. In addition, if the C content is in a range from 2.7% to 3.0%, the concatenated structure of graphite is significantly increased. Accordingly, the C content is set to 2.0% or more to less than 2.7%, or more than 3.0% to less than 3.6%. However, with the C content being 2.0% or more to less than 2.7%, even when the contents of Mn and Cu that are elements for stabilizing a pearlite structure are kept low, a pearlite ratio in a matrix structure becomes high, the strength among mechanical properties is increased more than necessary, and a desirable impact value may not be provided. Therefore, the C content is set to more than 3.0% to less than 3.6%.

Si is an element for facilitating crystallization of graphite. If the Si content is less than 1.5%, graphite is difficult to be crystallized, which may result in free cementite (chill) to significantly decrease workability. On the other hand, if the Si content is more than 3.0%, ferrite is embrittled to decrease an impact value in mechanical properties. Accordingly, the Si content is set to 1.5% to 3.0%.

Mn is an element for stabilizing a pearlite structure. If the Mn content is high, a pearlite ratio in a base structure is increased and tensile strength is increased. However, the effect is saturated if the content is more than 1.0%. Accordingly, the Mn content is set to 1.0% or less.

Cu is an element for stabilizing a pearlite structure. If the Cu content is high, a pearlite ratio in the base structure is increased and tensile strength is increased. However, the effect is saturated if the content exceeds 1.0%. Accordingly, the Cu content is set to 1.0% or less.

Mg is an element for affecting spheroidizing of graphite, and the Mg content is an indicator for determining the spheroidizing of graphite. If the Mg content is less than 0.02%, a graphite spheroidizing ratio is decreased and the Young's modulus is also decreased. On the other hand, if the Mg content is more than 0.07%, shrinkage cavities and chill may be easily generated. Accordingly, the Mg content is set to 0.02 to 0.07%.

P is an element entered as an impurity element. If the P content is increased, the ductility (toughness) of the spheroidal graphite cast iron is decreased. In the normal spheroidal graphite cast iron, if the P content is 0.05% or less, a decrease of the impact value may be saturated. In the case of the high rigid spheroidal graphite cast iron having the above-described composition, if the P content is 0.03% or more, it was turned out that the impact value is significantly decreased. It may be considered that if 0.03% or more of P is contained, the whole base structure is embrittled. In particular, it tends to increase the effect of embrittlement by containing P at the region where additive amounts of Mn and Cu are small.

Therefore, the P content is less than 0.03%. The lower limit of the P content is not limited, but the P content can be 0.010%, for example, in terms of production costs.

If the total contents of Mn and Cu are controlled to be 0.45 to 0.70%, both of the strength and the impact value are preferably improved. It may be considered that, by containing certain contents of Mn and Cu in the spheroidal graphite cast iron, the pearlite of the base structure is increased to improve the strength.

If the total contents of Mn and Cu are less than 0.45%, the strength may not be sufficiently improved.

If the total contents of Mn and Cu are more than 0.70%, the strength is improved, but the elongation and the impact value are decreased and the desirable mechanical properties may not be provided.

More preferably, the total contents of Mn and Cu are 0.50 to 0.65%.

If a ratio of the P content and the total contents of Mn and Cu (P/(Mn+Cu)) is 0.050 or less, the strength and the impact value can be preferably improved in a well balanced manner. It may be considered that if the ratio (P/(Mn+Cu)) is 0.050 or less, the pearlite of the base structure and the prevention of embrittlement in the whole structure are achieved in a well balanced manner.

If the total contents of Mn and Cu are less than 0.45%, the ratio of the P content is relatively increased, the ratio is more than 0.050 and the strength is decreased. On the other hand, if the total contents of Mn and Cu are 0.70% or more, the ratio is more than 0.050, which represents that the ratio of the P content is also increased, the strength is increased, but the toughness is decreased correspondingly.

As the high rigid spheroidal graphite cast iron according to the present invention has a hypoeutectic composition, chill may be easily generated as compared to the spheroidal graphite cast iron having the eutectic composition. In order to suppress the generation of chill, an inoculant such as ferrosilicon is preferably added upon casting. An inoculation method can be selected from ladle inoculation, pouring inoculation and in-mold inoculation depending on the shape, the thickness, etc. of the product. The inoculant can be commercially available ferrosilicon inoculants containing Si. The inoculant that can be used may contain Bi, Ba, Ca, RE (rare earths) or the like effective to suppress chilling and refining spheroidal graphite.

When the inoculant is added to the high rigid spheroidal graphite cast iron according to the present invention, no chilling is generated and sufficient mechanical properties can be provided, even though no heat treatment is applied after casting. In this way, the productivity and the production costs can be improved as compared to the spheroidal graphite cast iron having the eutectic composition that requires the heat treatment after casting.

<CE Value>

As described above, the C content and the CE value are decreased lower than those in the eutectic composition, a primary crystal is austenite upon solidification. The primary crystal of austenite is increased as the C content and the CE value get decreased. Accordingly, the concatenated structure of graphite subsequently crystallized emerges widely as the C content and the CE value get decreased. Once the concatenated structure of graphite exceeds a certain ratio, it becomes a starting point of tensile fracture. Fracture is induced before the tensile strength inherent to the material is gained. Thus, the tensile strength and the elongation are significantly lowered and no stable material properties can be provided.

Specifically, when the CE value is decreased from the eutectic composition (about 4.3%) to be more than 3.2% and less than 3.8%, the concatenated structure of graphite appears on a fracture surface of a tensile test piece.

If the area ratio of the concatenated structure of graphite is more than 50%, the concatenated structure of graphite becomes a starting point of fracture before the tensile strength and the elongation inherent to the material is gained. Thus, the tensile strength and the elongation are significantly lowered.

Therefore, in order to eliminate the impact on the tensile strength and the elongation, the area ratio of the concatenated structure of graphite is set to 50% or less and the CE value range is set to the range of 3.6 to 4.3%. If the upper limit of the CE value is 4.2%, a hypoeutectic composition is preferably provided.

As described above, by setting the C content and the CE value range, the high rigid spheroidal graphite cast iron having the Young's modulus of 170 GPa or more can be provided. The higher the Young's modulus is, the lighter the weight is. It is preferable that the Young's modulus be 175 GPa or more.

In addition, it is preferable that casting is performed within the CE range of 3.8 to 4.2% where no concatenated structure of graphite emerges. In particular, it is desirable that the ratio (P/(Mn+Cu)) is 0.050 or less within the CE range of 3.8 to 4.2% in that the Young's modulus is 170 GPa or more, a tensile strength is 550 MPa or more, and an impact value is 12 J/cm$^2$ or more.

According to the present invention, the balance between the tensile strength and the toughness is excellent and high rigid and stable mechanical properties are provided as described above, which is suitable to decrease the weight of the vehicle parts. Accordingly, the present invention can be preferably used for an undercarriage including a knuckle, a suspension arm and a brake caliper and engine parts including a crank shaft, a cam shaft and a piston ring. In particular, when the present invention is applied to a knuckle and a suspension arm that need to have a light weight among the vehicle parts, both of the strength and the rigidity are improved, and the parts can have a further light weight as compared with the material having only the improved strength is applied.

Example 1

A Fe—Si—Mg based molten metal was melted using a high frequency electric furnace. About 1.0 weight % of spheroidizing agent (Fe-45% Si-5% Mg) was added for spheroidization. Then, about 0.2 weight % of a ferrosilicon inoculant (Fe-75% Si) was added for inoculation. Thus, the composition shown in Table 1 was provided.

The molten metal was poured into a beta set mold 10 having cavities shown in FIG. 1. The mold was cooled to room temperature, and each molded product was taken out from the mold. A pouring temperature was set to 1400° C. The cavities of the beta set mold 10 were simulated for a thickness of a knuckle of the vehicle parts, and a plurality of round bars 3 each having a cross-sectional diameter of about 25 mm were disposed. In FIG. 1, a reference numeral 1 denotes a pouring gate, and a reference numeral 2 denotes a feeding head.

The resultant molded products were evaluated as follows:

Tensile strength and breaking elongation: Each round bar 3 of the molded products was cut, and a tensile test piece was produced by a turning process in accordance with JIS Z2241. The tensile test was performed in accordance with JIS Z2241 using the Amsler universal testing machine to measure the tensile strength and the breaking elongation.

Young's modulus: A cube having 10 mm sides was cut out from the round bar 3 of the molded product, and its density was measured by the Archimedes method. A longitudinal wave sound speed and a transversal wave sound speed were measured by a ultrasonic pulse method. From these values, the Young's modulus was calculated. As a measurement apparatus for the ultrasonic pulse method, "digital ultrasonic flaw detector UI-25" (product name) manufactured by Ryoden Shonan Electronics Corporation was used. An oscillator for longitudinal and transverse waves manufactured by Eishin Kagaku Co., Ltd. was used.

Impact value: Each round bar 3 of the molded products was cut, and a U-notched impact test piece was produced by a turning process in accordance with JIS Z2242. The impact test was performed in accordance with JIS Z2242 using the Charpy impact tester (50J) to measure the impact value at normal temperature.

Table 1 shows the results.

TABLE 1

| | Composition (wt %) | | | | | | | CE value | (Mn + Cu) | P/(Mn + Cu) | Tensile Strength | Young's modulus | Impact value |
|---|---|---|---|---|---|---|---|---|---|---|---|---|---|
| | C | Si | Mn | P | S | Cu | Mg | (%) | (wt %) | (wt %) | (MPa) | (GPa) | (J/cm2) |
| Ex. 1 | 3.200 | 2.150 | 0.270 | 0.023 | 0.012 | 0.260 | 0.038 | 3.92 | 0.53 | 0.043 | 562.6 | 174.9 | 16.2 |
| Ex. 2 | 3.200 | 2.150 | 0.270 | 0.023 | 0.012 | 0.260 | 0.038 | 3.92 | 0.53 | 0.043 | 566.1 | 174.9 | 16.9 |
| Ex. 3 | 3.200 | 2.140 | 0.290 | 0.027 | 0.011 | 0.290 | 0.039 | 3.92 | 0.58 | 0.047 | 597.1 | 174.5 | 15.5 |
| Ex. 4 | 3.200 | 2.140 | 0.290 | 0.027 | 0.011 | 0.290 | 0.039 | 3.92 | 0.58 | 0.047 | 599.1 | 174.5 | 15.9 |
| Ex. 5 | 3.200 | 2.110 | 0.290 | 0.026 | 0.011 | 0.290 | 0.039 | 3.91 | 0.58 | 0.045 | 592.0 | 174.3 | 16.5 |
| Ex. 6 | 3.090 | 2.210 | 0.320 | 0.023 | 0.011 | 0.320 | 0.038 | 3.83 | 0.64 | 0.036 | 611.7 | 175.8 | 13.5 |
| Ex. 7 | 3.090 | 2.240 | 0.310 | 0.022 | 0.011 | 0.310 | 0.038 | 3.84 | 0.62 | 0.035 | 591.4 | 175.8 | 13.1 |
| Ex. 8 | 3.090 | 2.190 | 0.320 | 0.022 | 0.011 | 0.320 | 0.038 | 3.82 | 0.64 | 0.034 | 603.8 | 175.6 | 13.3 |
| Comp. Ex. 1 | 3.070 | 2.130 | 0.240 | 0.037 | 0.006 | 0.060 | 0.034 | 3.78 | 0.30 | 0.123 | 535.0 | 174.8 | 13.9 |
| Comp. Ex. 2 | 3.070 | 2.120 | 0.230 | 0.036 | 0.006 | 0.060 | 0.034 | 3.78 | 0.29 | 0.124 | 523.4 | 174.8 | 15.3 |
| Comp. Ex. 3 | 3.020 | 2.100 | 0.440 | 0.034 | 0.006 | 0.100 | 0.038 | 3.72 | 0.54 | 0.063 | 585.2 | 175.9 | 11.3 |
| Comp. Ex. 4 | 3.020 | 2.130 | 0.440 | 0.033 | 0.006 | 0.110 | 0.038 | 3.73 | 0.55 | 0.060 | 585.8 | 175.9 | 10.0 |
| Comp. Ex. 5 | 3.090 | 2.220 | 0.540 | 0.035 | 0.006 | 0.110 | 0.038 | 3.83 | 0.65 | 0.054 | 584.8 | 175.8 | 8.7 |
| Comp. Ex. 6 | 3.090 | 2.220 | 0.540 | 0.038 | 0.007 | 0.100 | 0.038 | 3.83 | 0.64 | 0.059 | 586.7 | 175.8 | 10.0 |
| Comp. Ex. 7 | 3.070 | 2.140 | 0.290 | 0.034 | 0.008 | 0.220 | 0.031 | 3.79 | 0.51 | 0.067 | 565.0 | 175.6 | 11.1 |
| Comp. Ex. 8 | 3.120 | 2.350 | 0.240 | 0.027 | 0.010 | 0.230 | 0.034 | 3.90 | 0.47 | 0.057 | 548.2 | 174.7 | 16.9 |
| Comp. Ex. 9 | 3.150 | 2.140 | 0.420 | 0.027 | 0.008 | 0.320 | 0.038 | 3.86 | 0.74 | 0.036 | 701.0 | 176.0 | 6.8 |
| Comp. Ex. 10 | 3.090 | 2.200 | 0.230 | 0.021 | 0.011 | 0.210 | 0.039 | 3.82 | 0.44 | 0.048 | 540.1 | 174.9 | 17.8 |

As shown in Table 1, in each Example containing less than 0.03% of P and 0.45 to 0.70% of Mn and Cu in total, and satisfying that the ratio of the P content and the total contents of Mn and Cu (P/(Mn+Cu)) is 0.050 or less, the Young's modulus was improved to 170 GPa or more, the tensile strength was improved to 550 MPa or more, and the impact value was improved to 12 J/cm$^2$ or more.

On the other hand, in each of Comparative Examples 1 and 2 containing more than 0.03% of P, the tensile strength was lowered to less than 550 MPa. Since the total contents of Mn and Cu were less than 0.45% in each of Comparative Examples 1 and 2, it is contemplated that pearlite that contributes to the strength was decreased in the base structure.

Similarly, in each of Comparative Examples 3 to 7 containing more than 0.03% of P, the impact value was lowered to less than 12 J/cm$^2$. Since the total contents of Mn and Cu were more than 0.45% in each of Comparative Examples 3 to 7, the strength was increased, but it is contemplated that the toughness was decreased because the P content was more than 0.03%.

In Comparative Example 8 having the ratio (P/(Mn+Cu)) more than 0.05, the tensile strength was lowered to less than 550 MPa.

In Comparative Example 9 having the total content of Mn and Cu more than 0.70%, the impact value was lowered to less than 12 J/cm$^2$.

In Comparative Example 10 having the total contents of Mn and Cu less than 0.45%, the tensile strength was lowered to less than 550 MPa.

FIG. 2 is a graph of plotting the impact values of Examples and Comparative Examples in Table 1 in the horizontal axis, and plotting the tensile strength in the vertical axis.

DESCRIPTION OF REFERENCE NUMERALS

3 collected part (rounded bar) of molded product test piece

What is claimed is:

1. A high rigid spheroidal graphite cast iron, having a hypoeutectic composition, and consisting of more than 3.0% to less than 3.6% of C, 1.5 to 3.0% of Si, 1.0% or less of Mn, 1.0% or less of Cu, less than 0.03% of P, 0.02% to 0.07% of Mg, residual Fe and inevitable impurities, as represented by mass %, wherein a carbon equivalent (a CE value) calculated by the mathematical expression (1): CE=C %+Si %/3 in terms of C and Si contents is 3.6 to less than 4.2%, the Young's modulus is 174.3 GPa or more, the tensile strength is 550 MPa or more, and the impact value is 12 J/cm$^2$ or more, wherein the total contents of Mn and Cu are 0.45 to 0.70%, as represented by mass %, and a ratio (P/(Mn+Cu)) of the P content and the total content of Mn and Cu is 0.034 to 0.047% as represented by mass %.

* * * * *